US005701628A

United States Patent [19]

Morad

[11] Patent Number: 5,701,628

[45] Date of Patent: Dec. 30, 1997

[54] MOP HOLDER WITH A QUICK RELEASE LOCKING NUT

[75] Inventor: Fred L Morad, Toluca Lake, Calif.

[73] Assignee: Worldwide Integrated Resources, Inc., Glendale, Calif.

[21] Appl. No.: 686,532

[22] Filed: Jul. 26, 1996

[51] Int. Cl.[6] ..... A47L 13/258

[52] U.S. Cl. ..... 15/150; 15/228; 411/433; 411/437

[58] Field of Search ..... 15/150, 151, 153, 15/147.1, 228, 229.1, 229.2, 229.6, 146, 178; 411/433, 437, 941

[56] References Cited

U.S. PATENT DOCUMENTS

| | | | |
|---|---|---|---|
| 35,951 | 7/1862 | Reed et al. | 15/150 |
| 512,543 | 1/1894 | Froberg | 15/150 |
| 1,171,161 | 2/1916 | Wingender | 15/150 |
| 1,358,399 | 11/1920 | Somer et al. | 15/150 |
| 1,375,321 | 4/1921 | Rounds | 15/150 |
| 3,398,420 | 8/1968 | Manning | 15/150 |
| 3,497,901 | 3/1970 | Shipp | 15/150 |
| 5,230,596 | 7/1993 | Morad | 15/153 |

*Primary Examiner*—Gary K. Graham
*Attorney, Agent, or Firm*—Thomas I. Rozsa; Tony D. Chen

[57] ABSTRACT

A mop holder which incorporates a quick release locking nut for clamping a mop and attaching a mop stick. The mop holder comprises a hollow frame and a quick release locking nut which is installed on the frame. The frame has a central portion with a closed cavity for accommodating a conventional mop stick. A swingable mop clamping member is hingeably connected to one end of the base of the frame. The mop clamping member serves to clamp the mop fill to the base of the frame. A slidable attachment rod with outer screw threads is hingeably connected to the other end of the mop clamping member. The slidable attachment rod is inserted through an opening provided on the frame, where the rod is threadably engaged with a pawl on the quick release locking nut. The quick release locking nut can be rotated to tighten the mop clamping member to the frame, and thereby secures the mop fill thereto.

29 Claims, 2 Drawing Sheets

FIG.1
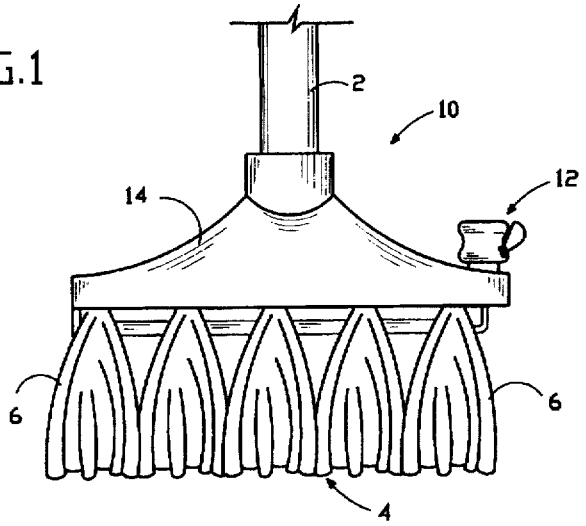
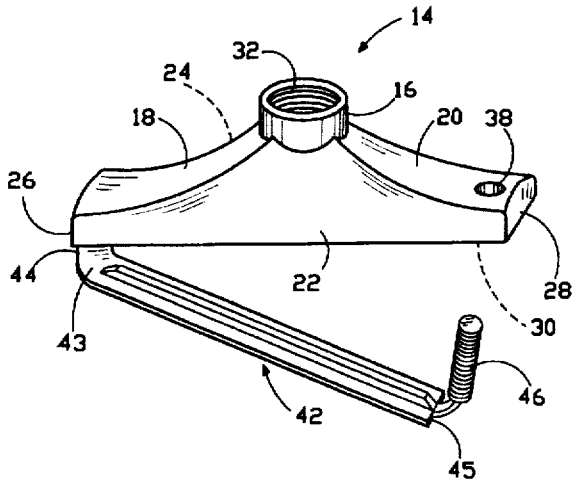
FIG.2
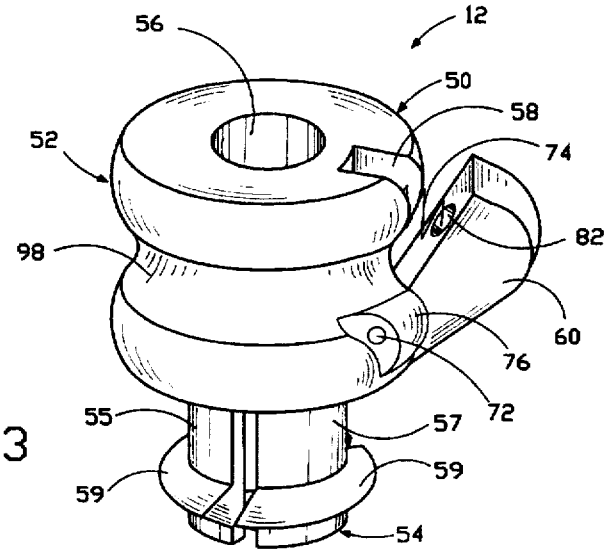
FIG.3

MOP HOLDER WITH A QUICK RELEASE LOCKING NUT

BACKGROUND OF THE INVENTION

1. Field of the Invention

The present invention generally relates to the field of mop holders. More particularly, the present invention relates to the field of mop holders adaptable to mops and mop sticks.

2. Description of the Prior Art

The inventor and applicant of the present invention is also the patentee of U.S. Pat. No. 5,230,596 issued on Jul. 27, 1993 (hereafter "the '596 Patent"). The inventor is aware of the prior art mop holders which were disclosed in the '596 Patent. While the patentee's prior art slidable and threadable quick release locking nut for quick change type mop holders functions adequately, the patentee has continuously sought to further improve mop holders for the consumer industry.

The '596 Patent discloses an improved quick release locking nut for quick change type mop holders. The mop holder has a frame attachable to a mop stick and a clamping member for securing mop fill. The quick release locking nut is slidably mounted on a central shank of the frame, and has a pivotally mounted pawl which is biased by a spring. The pawl has inner screw threads which engage with the outer screw threads on the central shank, in order to lock the quick release locking nut on the central shank for preventing the clamping member from sliding on the central shank. When the pawl is pressed against the spring and therefore is disengaged from the central shank, the quick release locking nut is unlocked and can slide on the central shank for allowing the clamping member to slide on the central shank so that the mop clamp can be released.

There is a need for various types of mop holders which are easy to use, where the clamp locking mechanism is not attached to the mop stick, so any kind of mop stick can be interchangeably adapted. Therefore, it is desirable to have a new mop holder where the clamp locking mechanism can be securely fastened and quickly released.

SUMMARY OF THE INVENTION

The present invention is a mop holder with a quick release locking nut for clamping a mop and attaching a mop stick.

The present invention mop holder comprises a hollow frame and a quick release locking nut which is installed on the frame. The frame has a central portion with a closed cavity for accommodating a conventional mop stick. A swingable mop clamping member is hingeably connected to one end of the base of the frame. The mop clamping member serves to clamp the mop fill to the base of the frame. A slidable attachment rod with outer screw threads is hingeably connected to the other end of the mop clamping member. The slidable attachment rod is inserted through an opening provided on the frame, where the rod is threadably engaged with a pawl on the quick release locking nut. The quick release locking nut can be rotated to tighten the mop clamping member to the frame, and thereby secures the mop fill thereto.

It is therefore an object of the present invention to provide a mop holder having a swingable mop clamping member which serves as a means to clamp the mop fill thereto, and a quick release locking nut for quickly securing or releasing the swingable mop clamping member.

It is also an object of the present invention to provide a mop holder with a quick release locking nut for quickly and easily installing it to the mop holder.

It is an additional object of the present invention to provide a mop holder with a quick release locking nut, where the quick release locking nut is provided with a pivotally mounted and spring biased pawl, such that when the tip of the pawl is engaged to a slidable attachment rod of the mop clamping member, it locks the movement of the attachment rod. However, by simply pressing the pawl against the coil spring, a user can free the movement of the attachment rod, which in turn frees the movement of the mop clamping member.

It is a further object of the present invention to provide a mop holder with a quick release locking nut, where outer screw threads are provided on the slidable attachment rod of the swingable mop clamping member, and inner screw threads are provided on the engaging tip of the spring biased pawl of the quick release locking nut, so that as the spring biased pawl of the quick release locking nut is engaged to the slidable attachment rod of the swingable mop clamping member, the quick release locking nut can be rotated to further thread on the slidable attachment rod of the swingable mop clamping member to precisely adjust the tightness or looseness of the mop clamping member.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is an illustrative side elevational view of the preferred embodiment of the present invention quick release locking mop holder, showing a mop and mop stick connected thereto, where the mop holder is in its fastened position;

FIG. 2 is a perspective view of the mop holder of the present invention, where the mop clamping member of the mop holder is in its released position;

FIG. 3 is an enlarged perspective view of the quick release locking nut of the present invention;

DESCRIPTION OF THE PREFERRED EMBODIMENT

Figure 4:
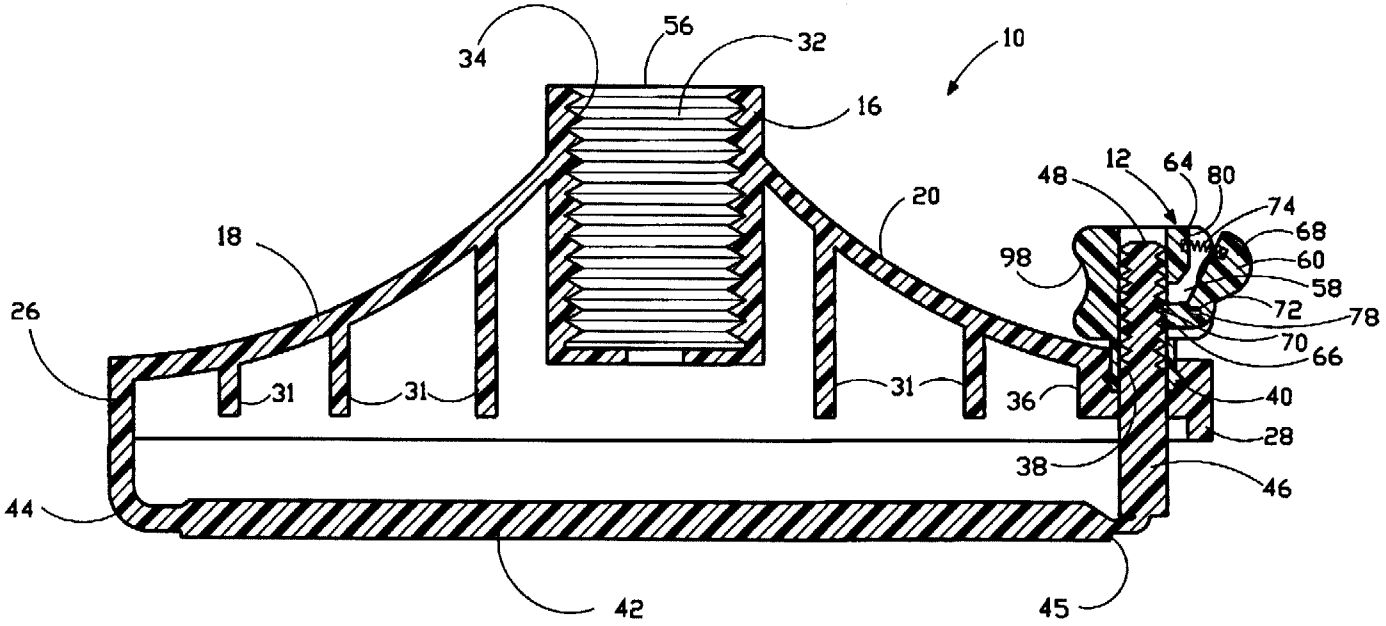
FIG. 4 is an enlarged longitudinal cross-sectional view of the present invention quick release locking mop holder.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The principal advantage of the present invention is that it provides an improved mop holder which incorporates a one-piece mop holder and a quick release locking nut. The present invention mop holder is easy and quick to use.

Referring to FIG. 1, there is shown the present invention quick release locking mop holder 10 which incorporates a quick release locking nut 12. The mop holder 10 can be interchangeably adapted to a conventional mop stick 2 which is partially shown in this figure and adjustably clamped to a mop 4 which is made of a plurality of elongated flexible strips 6.

Referring to FIG. 2, the mop holder 10 has a generally triangular shaped hollow frame 14 as its basic structure. The hollow frame 14 comprises a central cylindrical shaped shaft 16 which extends downwardly towards the ground, two downwardly tapered top walls 18 and 20 integrally formed at opposite sides of the central shaft 16, a pair of opposite longitudinal sidewalls 22 and 24, and two opposite transverse end walls 26 and 28. The two pairs of walls 22, 24, 26 and 28 are integrally formed with and extend downwardly from the tapered top walls 18 and 20 to form a bottom opening 30.

Referring to FIG. 4, there is shown a cross-sectional view of the present invention quick release locking mop holder 10. The central shaft 16 has a closed cavity 32 with inner screw threads 34 for threadedly engaging with the mop stick 2 (not shown in FIG. 4). An attachment socket 36 is integrally formed within the hollow frame 14 and located adjacent to the transverse end wall 28, and between the pair of sidewalls 22 and 24 and the top wall 20. The attachment socket 36 has a channel slot 38 therethrough which extends from the top wall 20 of the frame 14 through the bottom opening 30 of the frame 14, and an arrowhead shaped annular groove 40 which interconnects with the channel slot 38.

Figure 5:
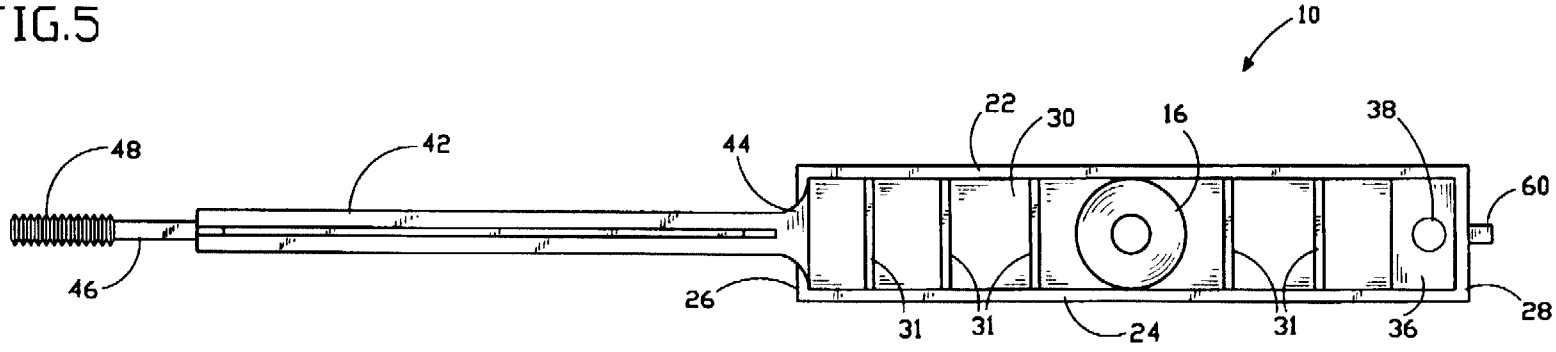
FIG. 5 is a bottom plan view of the present invention quick release locking mop holder in its released and extended position.

Referring to FIGS. 2, 4 and 5, there is shown a longitudinal swingable mop clamping member 42 which has one end 43 hingeably connected to the bottom of the transverse end wall 26 of the frame 14 by a living hinge 44. The opposite end 45 of the mop clamping member 42 is integrally formed with a cylindrical shaped slidable attachment rod 46 for slidable insertion through the channel slot 38 of the attachment socket 36 for clamping the mop 4 thereto (as shown in FIG. 1). The slidable attachment rod 46 has outer screw threads 48. The length of the mop clamping member 42 should be approximately the same as the distance between the transverse end wall 26 and the center of the channel slot 38 of the attachment socket 36, so that the slidable attachment rod 46 is fitted precisely within the channel slot 38 when locked. This attachment enables the user to have the mop 4 easily installed onto or removed from the frame 14 of the mop holder 10.

Referring to FIGS. 4 and 5, there is shown a plurality of spaced apart transverse rib dividers 31 integrally formed between the pair of longitudinal sidewalls 22 and 24 of the frame 14 for providing stability to the hollow frame 14 of the mop holder 10.

Referring to FIG. 3, there is shown at 12 the quick release locking nut used in conjunction with the mop holder 10. The quick release locking nut 12 has a generally cylindrical shaped body 50 with an upper portion 52 and a lower portion 54. The body 50 has a central slot 56 for accommodating the slidable attachment rod 46. The upper portion 52 has a side slot 58 for accommodating a pawl 60 and interconnecting with the central slot 56. The lower portion 54 has two spaced apart halves 55 and 57, where each half has an outer annular protruding ridge 59. The outer diameter of the lower portion 54 is smaller than the outer diameter of the upper portion 52.

Now referring to FIG. 4, a thin wall 64 is disposed between the central slot 56 and the side slot 58 to partially divide them, so the side slot 58 is partially connected with the central slot 56. There is also an annular groove 98 provided at the outer sidewall of the body 50 of the quick release locking nut 12 that enables the user to handle the quick release locking nut 12 more easily, so that a user can firmly grip the quick release locking nut 12 to rotate it.

Referring to FIGS. 3 and 4, the pawl 60 has an inwardly protruded tip 66 and an outwardly extended tail 68. The tip 66 is provided with inner screw threads 70. The pawl 60 is pivotally mounted in the side slot 58 by a roll pin 72 and biased by a coil spring 74. There are two aligned holes 76 (only one is shown) on the banks of the side slot 58 of the quick release locking nut 12, and a closed recess 78 on the pawl 60, all for receiving the roll pin 72. In addition, there is an outward facing recess 80 provided on the dividing wall 64 of the quick release locking nut 12, and an inward facing recess 82 provided on the pawl 60, for adapting the coil spring 74. As the pawl 60 is pivoted in the side slot 58 of the quick release locking nut 12 by the roll pin 72, it is biased by the coil spring 74 such that the pawl's tip 66 is extending into the central slot 56 of the quick release locking nut 12 and its tail 68 is extending out of the side slot 58 of the quick release locking nut 12.

The quick release locking nut 12 is a self-contained unit wherein the pawl 60 and the spring 74 are securely attached to the quick release locking nut 12 even when the quick release locking nut 12 is not mounted on the frame 14 of the mop holder 10. The width of the pawl 60 is approximately the same as the width of the side slot 58, so that when the spring 74 is installed in the side slot 58 of the quick release locking nut 12, it is not exposed outside of the quick release locking nut 12. This feature prevents the elongated flexible mop strips from becoming entangled with the spring 74, when the mop is in use or is being washed.

The quick release locking nut 12 is mounted on the hollow frame 14 of the mop holder 10 by squeezing the two spaced apart halves 55 and 57 of the lower portion 54 together such that the lower portion 54 is press fitted within the channel slot 38 of the attachment socket 36, where the annular protruding ridges 59 of the two halves 55 and 57 engage the arrowhead groove 40 on the attachment socket 36. The quick release locking nut 12 is easily assembled onto or disassembled from the frame 14.of the mop holder 10.

Referring to FIGS. 1 and 4, the operation of the foregoing embodiment now will be described. The lower portion 54 of the quick release locking nut 12 is press fitted within the channel slot 38 provided by the attachment socket 36, where the slidable attachment rod 46 is also installed thereto. When the tail 68 of the pawl 60 is pressed against the coil spring 74, the tail 68 of the pawl 60 moves inwardly towards the body 50 of the quick release locking nut 12, and the tip 66 of the pawl 60 is disengaged from the slidable attachment rod 46, which releases the slidable attachment rod 46 and allows the slidable attachment rod 46 to slide freely into or out from the channel slot 38 of the attachment socket 36. When, the mop clamping member 42 is released, a user can install or remove a mop. Because the slidable attachment rod 46 is slidable within the channel slot 38 as the pawl 60 is pressed, releasing the mop clamping member 42 becomes a very quick operation.

After the mop is installed, the mop clamping member 42 is swung towards the bottom of the frame 14 of the mop holder 10 to clamp the mop 4. The slidable attachment rod 46 is slid into the channel slot 38 of the attachment socket 36 while the tail 68 of the pawl 60 is pressed. Once the attachment rod 46 is within the channel slot 38, the tail 68 of the pawl 60 is released such that the inner screw threads 70 on the tip 66 will engage with the outer screw threads 48 on the slidable attachment rod 46, which prevents the slidable attachment rod 46 from sliding out from the channel slot 38, which in turn prevents the mop clamping member 42 from releasing the mop. Moreover, as the inner screw threads 70 on the tip 66 of the pawl 60 are engaged with the outer screw threads 48 on the slidable attachment rod 46, the quick release locking nut 12 can be further threaded on the slidable attachment rod 46 by rotating the body 50 of the quick release locking nut 12 clockwise to precisely adjust the tightness of the mop clamping member 42 or rotating the body 50 of the quick release locking nut 12 counter-clockwise to loosen the mop clamping member 42.

The present invention conforms to conventional forms of manufacture or any other conventional way known to one skilled in the art, and is of simple construction and is easy to use. The manufacturing process which could accommodate the construction of the mop holder may be injection, thermoform, etc. or other molding process. The mop holder may be made of any suitable material. Preferably it is made of plastic material. The frame of the mop holder is hollow for reducing the weight of the mop holder and the cost of manufacture. For example, the quick release locking nut 12 may be made of hard molded plastic, and may further have extra eccentric slots for reducing its weight.

The present invention has many advantageous features, including: (a) it does not mount any fastening or locking mechanism members onto the mop stick, so that it can be independently manufactured, transported and stored, and interchangeably used with any type of standard mop stick; (b) the cylindrical shaped slidable attachment rod and the quick release locking nut enables quick fastening and releasing of the mop clamp member; (c) the spring biased pawl offers secured locking of the quick release locking nut, which in turn securely prevents the slidable attachment rod from sliding out from the channel slot of the attachment socket of the frame; (d) the quick release locking nut can further be threaded on the slidable attachment rod, which provides a fine adjustment of the tightness or looseness of the mop clamp member; and (e) the mop can be easily installed onto or removed from the mop holder. In addition, it has a strong but light weighted construction, and is simple and inexpensive to produce, and easy and durable to use. By having the hollow frame structure, it reduces the weight of the frame and the cost associated with a solid frame.

Defined in detail, the present invention is a mop holder for adapting a mop stick and clamping a mop which is made of a plurality of elongated flexible strips, the mop holder comprising: (a) a triangular shaped hollow frame having a downwardly extending central cylindrical shaped shaft portion, a pair of downwardly tapered top walls integrally formed at opposite sides of the central shaft portion, a pair of opposite longitudinal sidewalls and a pair of opposite transverse end walls, the pair of sidewalls and the pair of end walls integrally formed with and downwardly extending from the pair of tapered top walls which form a bottom opening, the central shaft portion having a closed cavity with inner screw threads for threadedly engaging with said mop stick; (b) an attachment socket integrally formed within said hollow frame and located adjacent to one of said pair of end walls, and between said pair of sidewalls and a respective one of said pair of top walls, the attachment socket having a channel slot extending through from the respective one of said pair of top walls of said frame to said bottom opening of said frame and an inner arrowhead annular shaped groove interconnecting with the channel slot; (c) a longitudinal swingable mop clamping member having one end hingeably connected to the other one of said pair of end walls of said frame by a living hinge; (d) a cylindrical shaped slidable attachment rod integrally formed on another end of said longitudinal mop clamping member opposite from said living hinge for slidably inserting through said channel slot of said attachment socket for clamping said mop thereto, the slidable attachment rod having outer screw threads; (e) a quick release locking nut having a generally cylindrical shaped body with an upper portion, a lower portion and a central slot for accommodating said slidable attachment rod, the upper portion having a side slot interconnecting with the central slot and an outer annular groove so that a user can firmly grip the body of the quick release locking nut to rotate it, the lower portion having two spaced apart halves, each half having an outer annular protruding ridge, where the two spaced apart halves are squeezable toward each other to be press fitted within said channel slot of said attachment socket with the annular protruding ridges engaging said arrowhead annular shaped groove, the outer diameter of the lower portion being smaller than the outer diameter of the upper portion; (f) a pawl pivotally mounted in said side slot of said cylindrical shaped body of said quick release locking nut and having a tip with inner screw threads; (g) a coil spring biasing said tip of said pawl to engage it onto said slidable attachment rod, the coil spring being installed in said side slot; (h) said quick release locking nut being a self-contained unit wherein said pawl and said coil spring are securely attached to said upper portion of said cylindrical shaped body of said quick release locking nut even when said lower portion of said quick release locking nut is not installed within said attachment socket; (i) a thin wall disposed between said central slot and said side slot to partially divide them, so that said side slot is partially connected with said central slot; (j) said thin wall disposed between said central slot and said side slot having an outward facing recess for adapting one end of said biasing spring; and (k) said pawl having an inward facing recess located remote from said tip for adapting an opposite end of said biasing spring; (l) whereby when said pawl is pressed against said spring and its tip is disengaged from said slidable attachment rod, said quick release locking nut is unlocked and said slidable attachment rod can be slid out from said attachment socket for allowing said mop clamping member to be released, and when said pawl is biased by said spring and its tip is engaged to said slidable attachment rod, said quick release locking nut is locked on said slidable attachment rod for preventing said mop clamping member from being released, and said quick release locking nut can be rotated to further thread on said slidable attachment rod to precisely adjust the tightness of said mop clamping member.

Defined broadly, the present invention is a mop holder for adapting a mop stick thereto and clamping a mop which is made of a plurality of flexible strips, the mop holder comprising: (a) a hollow frame having a shaft portion for adapting to said mop stick, two top walls integrally formed at opposite sides of the shaft portion, two sidewalls and two end walls, the sidewalls and the end walls integrally formed with and downwardly extending from the top walls which form a bottom opening; (b) an attachment socket integrally formed within said hollow frame and located adjacent to one of said two end walls, and between said two sidewalls and a respective one of said two top walls, the attachment socket having a slot extending through from the respective one of said two top walls of said frame to said bottom opening of said frame and an inner groove interconnecting with the slot; (c) a swingable mop clamping member having one end hingeably connected to the other one of said two end walls of said frame by a living hinge; (d) a slidable attachment rod integrally formed on another end of said mop clamping member opposite from said living hinge for slidably inserting through said slot of said attachment socket for clamping said mop thereto, the slidable attachment rod having outer screw threads; (e) a quick release locking nut having an upper portion, a lower portion and a central slot for accommodating said slidable attachment rod, the upper portion having a side slot interconnecting with the central slot, the lower portion having two spaced apart halves, each half having a protruding ridge, where the two spaced apart halves are squeezable toward each other to be press fitted within said slot of said attachment socket with the protruding ridges engaging said inner groove of said attachment socket; (f) a pawl pivotally mounted in said side slot of said quick release locking nut and having a tip with inner screw threads; and (g) a spring being installed in said side slot of said quick release locking nut and biasing said tip of said pawl to engage it onto said slidable attachment rod; (h) whereby when said pawl is pressed against said spring and its tip is disengaged from said slidable attachment rod, said quick release locking nut is unlocked and said slidable attachment rod can be slid out from said attachment socket for allowing said mop clamping member to be released, and when said pawl is biased by said spring and its tip is engaged to said slidable attachment rod, said quick release locking nut is locked onto said slidable attachment rod for preventing said mop clamping member from being released, and said quick release locking nut can be rotated to further thread on said slidable attachment rod to precisely adjust the tightness of said mop clamping member.

Defined more broadly, the present invention is a mop holder, comprising: (a) a frame; (b) a clamping member hingeably connected to said frame at one end; (c) a rod member attached to said clamping member at an opposite end and having outer threads; (d) a locking nut having a central slot for accommodating said rod member, the locking nut further having means for attachment to said frame; (e) a spring biased pawl pivotally mounted to said locking nut such that its tip is engagable to said rod member; and (f) said tip of said spring biased pawl further having inner threads threadedly engagable to said outer threads of said rod member for fastening said clamping member; (g) whereby when said pawl is pressed against said spring and its tip is disengaged from said rod member, said locking nut is unlocked and said rod member can be slid out from said locking nut for allowing said clamping member to be released, and when said pawl is biased by said spring and its tip is engaged to said rod member, said locking nut is locked on said rod member for preventing said clamping member from being released so that said clamping member can be fastened, and said locking nut can be rotated to further thread on said rod member to precisely adjust the tightness of said clamping member.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A mop holder for adapting a mop stick and clamping a mop which is made of a plurality of elongated flexible strips, the mop holder comprising:

a. triangular shaped hollow frame having a downwardly extending central cylindrical shaped shaft portion, a pair of downwardly tapered top walls integrally formed at opposite sides of the central shaft portion, a pair of opposite longitudinal sidewalls and a pair of opposite transverse end walls, the pair of sidewalls and the pair of end walls integrally formed with and downwardly extending from the pair of tapered top walls which form a bottom opening, the central shaft portion having a closed cavity with inner screw threads for threadedly engaging with said mop stick;

b. an attachment socket integrally formed within said hollow frame and located adjacent to one of said pair of end walls, and between said pair of sidewalls and a respective one of said pair of top walls, the attachment socket having a channel slot extending through from the respective one of said pair of top walls of said frame to said bottom opening of said frame and an inner arrowhead annular shaped groove interconnecting with the channel slot;

c. a longitudinal swingable mop clamping member having one end hingeably connected to the other one of said pair of end walls of said frame by a living hinge;

d. a cylindrical shaped slidable attachment rod integrally formed on another end of said longitudinal mop clamping member opposite from said living hinge for slidably inserting through said channel slot of said attachment socket for clamping said mop thereto, the slidable attachment rod having outer screw threads;

e. a quick release locking nut having a generally cylindrical shaped body with an upper portion, a lower portion and a central slot for accommodating said slidable attachment rod, the upper portion having a side slot interconnecting with the central slot and an outer annular groove so that a user can firmly grip the body of the quick release locking nut to rotate it, the lower portion having two spaced apart halves, each half having an outer annular protruding ridge, where the two spaced apart halves are squeezable toward each other to be press fitted within said channel slot of said attachment socket with the annular protruding ridges engaging said arrowhead annular shaped groove, the outer diameter of the lower portion being smaller than the outer diameter of the upper portion;

f. a pawl pivotally mounted in said side slot of said cylindrical shaped body of said quick release locking nut and having a tip with inner screw threads;

g. a coil spring biasing said tip of said pawl to engage it onto said slidable attachment rod, the coil spring being installed in said side slot;

h. said quick release locking nut being a self-contained unit wherein said pawl and said coil spring are securely attached to said upper portion of said cylindrical shaped body of said quick release locking nut even when said lower portion of said quick release locking nut is not installed within said attachment socket;

i. a thin wall disposed between said central slot and said side slot to partially divide them, so that said side slot is partially connected with said central slot;

j. said thin wall disposed between said central slot and said side slot having an outward facing recess for adapting one end of said biasing spring; and k. said pawl having an inward facing recess located remote from said tip for adapting an opposite end of said biasing spring;

l. whereby when said pawl is pressed against said spring and its tip is disengaged from said slidable attachment rod, said quick release locking nut is unlocked and said slidable attachment rod can be slid out from said attachment socket for allowing said mop clamping member to be released, and when said pawl is biased by said spring and its tip is engaged to said slidable attachment rod, said quick release locking nut is locked on said slidable attachment rod for preventing said mop clamping member from being released, and said quick release locking nut can be rotated to further thread on said slidable attachment rod to precisely adjust the tightness of said mop clamping member.

2. The mop holder in accordance with claim 1 further comprising a plurality of spaced apart transverse rib dividers integrally formed between said pair of longitudinal sidewalls of said hollow frame for providing stability.

3. The mop holder in accordance with claim 1 wherein said spring biased pawl is pivotally mounted in said side slot of said quick release locking nut by a roll pin.

4. The mop holder in accordance with claim 3 wherein said upper portion of said cylindrical shaped body of said quick release locking nut is further provided with two aligned holes respectively on two opposite banks of said side slot for accommodating said roll pin.

5. The mop holder in accordance with claim 1 wherein said tip of said pawl is inwardly protruding and the pawl has a widened tail which is outwardly extended.

6. The mop holder in accordance with claim 1 wherein the width of said pawl is approximately the same as the width of said side slot, so that when said spring is installed in said side slot, said pawl is completely concealed.

7. A mop holder for adapting a mop stick thereto and clamping a mop which is made of a plurality of flexible strips, the mop holder comprising:

a. a hollow frame having a shaft portion for adapting to said mop stick, two top walls integrally formed at opposite sides of the shaft portion, two sidewalls and two end walls, the sidewalls and the end walls integrally formed with and downwardly extending from the top walls which form a bottom opening;

b. an attachment socket integrally formed within said hollow frame and located adjacent to one of said two end walls, and between said two sidewalls and a respective one of said two top walls, the attachment socket having a slot extending through from the respective one of said two top walls of said frame to said bottom opening of said frame and an inner groove interconnecting with the slot;

c. a swingable mop clamping member having one end hingeably connected to the other one of said two end walls of said frame by a living hinge;

d. a slidable attachment rod integrally formed on another end of said mop clamping member opposite from said living hinge for slidably inserting through said slot of said attachment socket for clamping said mop thereto, the slidable attachment rod having outer screw threads;

e. a quick release locking nut having an upper portion, a lower portion and a central slot for accommodating said slidable attachment rod, the upper portion having a side slot interconnecting with the central slot, the lower portion having two spaced apart halves, each half having a protruding ridge, where the two spaced apart halves are squeezable toward each other to be press fitted within said slot of said attachment socket with the protruding ridges engaging said inner groove of said attachment socket;

f. a pawl pivotally mounted in said side slot of said quick release locking nut and having a tip with inner screw threads; and g. a spring being installed in said side slot of said quick release locking nut and biasing said tip of said pawl to engage it onto said slidable attachment rod;

h. whereby when said pawl is pressed against said spring and its tip is disengaged from said slidable attachment rod, said quick release locking nut is unlocked and said slidable attachment rod can be slid out from said attachment socket for allowing said mop clamping member to be released, and when said pawl is biased by said spring and its tip is engaged to said slidable attachment rod, said quick release locking nut is locked onto said slidable attachment rod for preventing said mop clamping member from being released, and said quick release locking nut can be rotated to further thread on said slidable attachment rod to precisely adjust the tightness of said mop clamping member.

8. The mop holder in accordance with claim 7 further comprising a plurality of spaced apart transverse ribs integrally formed between said two sidewalls of said hollow frame for providing stability.

9. The mop holder in accordance with claim 7 wherein said spring biased pawl is pivotally mounted in said side slot of said quick release locking nut by a roll pin.

10. The mop holder in accordance with claim 9 wherein said upper portion of said quick release locking nut is further provided with two aligned holes respectively on two opposite banks of said side slot for accommodating said roll pin.

11. The mop holder in accordance with claim 7 wherein said tip of said pawl is inwardly protruding and the pawl has a widened tail which is outwardly extended.

12. The mop holder in accordance with claim 7 wherein the width of said pawl is approximately the same as the width of said side slot, so that when said spring is installed in said side slot, said pawl is completely concealed.

13. The mop holder in accordance with claim 7 wherein said quick release locking nut is a self-contained unit wherein said pawl and said spring are securely attached to said upper portion of said quick release locking nut even when said lower portion of said quick release locking nut is not installed within said attachment socket.

14. The mop holder in accordance with claim 7 further comprising a thin wall disposed between said central slot and said side slot to partially divide them, so that said side slot is partially connected with said central slot.

15. The mop holder in accordance with claim 14 wherein said thin wall has an outward facing recess for adapting to one end of said spring.

16. The mop holder in accordance with claim 15 wherein said pawl has an inward facing recess located remote from said tip for adapting the other end of said spring.

17. The mop holder in accordance with claim 7 wherein said quick release locking nut further comprises an outer annular groove so that a user can firmly grip said quick release locking nut to rotate it.

18. A mop holder, comprising:

a. a frame;

b. an elongated clamping member hingeably connected to said frame at one end thereof;

c. a rod member attached to said clamping member at an opposite end and having outer threads;

d. a locking nut having a central slot for accommodating said rod member, the locking nut further having means for attachment to said frame;

e. a spring biased pawl pivotally mounted to said locking nut such that its tip is engagable to said rod member; and f. said tip of said spring biased pawl further having inner threads threadedly engagable to said outer threads of said rod member for fastening said clamping member;

g. whereby when said pawl is pressed against said spring and its tip is disengaged from said rod member, said locking nut is unlocked and said rod member can be slid out from said locking nut for allowing said clamping member to be released, and when said pawl is biased by said spring and its tip is engaged to said rod member, said locking nut is locked on said rod member for preventing said clamping member from being released so that said clamping member can be fastened, and said locking nut can be rotated to further thread on said rod member to precisely adjust the tightness of said clamping member.

19. The mop holder in accordance with claim 18 further comprises at least two remote transverse ribs attached within said frame for providing stability.

20. The mop holder in accordance with claim 18 wherein said spring biased pawl is pivotally mounted in said side slot of said locking nut by a roll pin.

21. The mop holder in accordance with claim 20 wherein said locking nut is further provided with two aligned holes respectively on two opposite banks of said side slot for accommodating said roll pin.

22. The mop holder in accordance with claim 18 wherein said tip of said pawl is inwardly protruding and the pawl has a widened tail which is outwardly extended.

23. The mop holder in accordance with claim 18 wherein the width of said pawl is approximately the same as the width of said side slot, so that when said spring is installed in said side slot, said pawl is completely concealed.

24. The mop holder in accordance with claim 18 further comprising a thin wall disposed between said central slot and said side slot to partially divide them, so that said side slot is partially connected with said central slot.

25. The mop holder in accordance with claim 24 wherein said thin wall has an outward facing recess for adapting to one end of said spring.

26. The mop holder in accordance with claim 25 wherein said pawl has an inward facing recess located remote from said tip for adapting the other end of said spring.

27. The mop holder in accordance with claim 18 wherein said locking nut further comprises an outer annular groove so that a user can firmly grip said locking nut to rotate it.

28. The mop holder in accordance with claim 18 wherein said frame comprises an attachment socket having a slot extending through said frame and an inner groove interconnecting with the slot.

29. The mop holder in accordance with claim 28 wherein said means for attaching itself to said frame includes at least two spaced apart halves, each half having a protruding ridge, where the at least two spaced apart halves are squeezable toward each other to be press fitted within the slot in the attachment socket with the protruding ridges engaging an inner groove of said attachment socket.

* * * * *